US005542331A

United States Patent [19]

Hartmann et al.

[11] Patent Number: 5,542,331

[45] Date of Patent: Aug. 6, 1996

[54] SOUND-PRODUCING REED FOR WIND INSTRUMENTS

[76] Inventors: Harry Hartmann, Alte Weinsteige 67, D-70180 Stuttgart; Dieter Hahn, Augustenstr. 120, D-70197 Stuttgart, both of Germany

[21] Appl. No.: 331,612

[22] PCT Filed: Apr. 24, 1993

[86] PCT No.: PCT/EP93/00996

§ 371 Date: Nov. 4, 1994

§ 102(e) Date: Nov. 4, 1994

[87] PCT Pub. No.: WO93/22761

PCT Pub. Date: Nov. 11, 1993

[30] Foreign Application Priority Data

May 4, 1992 [DE] Germany ..... 42 14 336.5

[51] Int. Cl.[6] ..... G10D 9/02

[52] U.S. Cl. ..... 84/383 A

[58] Field of Search ..... 84/383 A, 380 A

[56] References Cited

U.S. PATENT DOCUMENTS 3,420,132 1/1969 Backus ..... 84/383 A 4,355,560 10/1982 Shaffer ..... 84/383 A

*Primary Examiner*—Cassandra C. Spyrou

*Attorney, Agent, or Firm*—Anderson Kill Olick & Oshinsky, P.C.

[57] ABSTRACT

The invention is directed to a sound-producing reed for wind instruments which is made from fiber-reinforced plastic and is characterized in that the basic material of the plastic is stabilized by at least one unidirectional layer (27, 29) having fiber strands (31) extending in the longitudinal direction of the reed (7), some of these strands (33) having different material characteristics for the purpose of damping the vibrations of the reed (7).

23 Claims, 1 Drawing Sheet

SOUND-PRODUCING REED FOR WIND INSTRUMENTS

BACKGROUND OF THE INVENTION

The invention is directed to a sound-producing reed for wind instruments made from fiber-reinforced plastic.

Numerous wind instruments are provided with a sound-producing reed, e.g., saxophones and clarinets among others. These instruments have a mouthpiece to which the reed is fastened in a suitable manner, e.g., by means of a reed clamp. There are also instruments having double-reeds, e.g., oboes and bassoons.

Generally, cane wood is used to manufacture such sound-producing reeds. The disadvantage to wooden reeds lies in their very limited durability and very costly manufacture. Moreover, every wooden reed must be broken in: every time the wooden reed is attached to the mouthpiece of the instrument—that is, not only when an unused, new reed is used for the first time—a break-in period of roughly one half hour is required. During this period, the playing properties of the wooden reed change as a result of taking on moisture. Also, this natural material is very sensitive. In particular, tears frequently occur in the region of the tip of the reed rendering the reed unusable.

It is also known to manufacture sound-producing reeds from plastic. However, the sound produced by these reeds falls far short of the quality which can be achieved by wooden reeds. Moreover, it is necessary at least to accustom oneself to the surface structure or texture and many players reject such reeds for this reason.

Finally, it was attempted to produce sound-producing reeds from fiber composites or fiber-reinforced plastic. However, the sound quality which could be achieved by reeds of this type was still such that many players of wind instruments were compelled to use wooden reeds in spite of the disadvantages mentioned above.

The object of the present invention is to provide a sound-producing reed for wind instruments from fiber-reinforced plastic which has substantially improved sound qualities, playing characteristics which very closely approximate those of wooden reeds, and a surface texture which is very pleasant to the user.

SUMMARY OF THE INVENTION

This object is met in a sound-producing reed by novel means according to the present invention. In order to achieve very good sound quality in a sound-producing reed whose durability is at the same time considerably improved over conventional plastic reeds and wooden reeds, the basic material of the plastic or plastics matrix has at least one layer having strands of fibers which extend in the longitudinal direction so as to be parallel to one another in one direction, some of which fiber strands have material characteristics differing from the other fiber strands for the purpose of damping vibrations in the reed.

In a preferred embodiment example of a reed, some of the unidirectional fiber strands comprise hollow fibers. The latter have proven particularly successful in influencing the sound characteristics of the sound-producing reed. Moreover, a reed blank containing hollow fibers is very amenable to further processing.

In another preferred embodiment example of the sound-producing reed, the layer of unidirectional fiber strands is constructed as a carbon-fiber woven fabric. A layer of this kind is relatively easy to produce. Moreover, a reed constructed in this manner is characterized by particularly good sound qualities.

In another preferred embodiment example of the sound-producing reed, there is provided, in addition to a carrier layer whose fibers preferably extend at right angles relative to one another, at least one supporting layer having fibers which preferably extend at right angles relative to one another and are arranged so as to be offset to the fibers of the carrier layer. Due to this construction, the reed has a high degree of stability and, as a result, uniform sound characteristics. Further, wear occurring with use is kept very low. Tearing particularly in the region of the front edge of the reed—the tip of the reed—is prevented due to the offset arrangement of the fibers of the supporting layer and carrier layer.

In a particularly preferred embodiment form of the reed, the carrier layer and/or supporting layer are/is arranged at the underside of the reed and the layer with unidirectional fiber strands is supported on these layers. The underside of the reed is accordingly very stable and rigid against torsion so as to ensure good support on the mouthpiece of the wind instrument. On the other hand, the layer of unidirectional fiber strands lying on top of the carrier layer or stabilizing layer exerts a positive influence on the sound qualities of the reed.

Finally, in a particularly preferred embodiment example of a sound-producing reed, there are at least two layers in the region of the edge of the tip of the reed and the dividing plane between these two layers is arranged approximately in the center between the upper side and underside of the tip of the reed. This ensures that there are at least two layers in the particularly sensitive edge region which is subject to frequent tearing, these two layers forming the upper side and underside of the tip or the reed. The fibers of the resulting layers are offset or turned relative to one another so as to eliminate initial tearing of the edge of the reed in a particularly reliable fashion.

The invention is explained more fully in the following with reference to the drawing.

DETAILED DESCRIPTION OF THE PREFERRED EMBODIMENTS

Sound-producing reeds as described herein can be used for a wide variety of wind instruments, in particular for saxophones and clarinets. In these instruments, a reed is attached to the mouthpiece of the instrument in such a way that it virtually closes an opening arranged at the mouthpiece. The rear region of the reed, i.e., its shank, is fastened to the mouthpiece by a suitable clamping device, preferably a reed clamp, in such a way that the front end or tip of the reed facing the mouth of the player can vibrate freely over the opening in the mouthpiece.

Sound-producing reeds of the type described in the following can also be used in wind instruments having double reeds, e.g., oboes and bassoons. In these instruments, two sound-producing reeds are so arranged, one above the other, that when blowing on the reeds an air column is set in vibration so that there is produced in the interior of the wind instrument a vibrating air column whose length can be varied by opening and closing the openings which are provided in the wind instrument for this purpose so that tones of various pitch can be produced.

Figure 1:
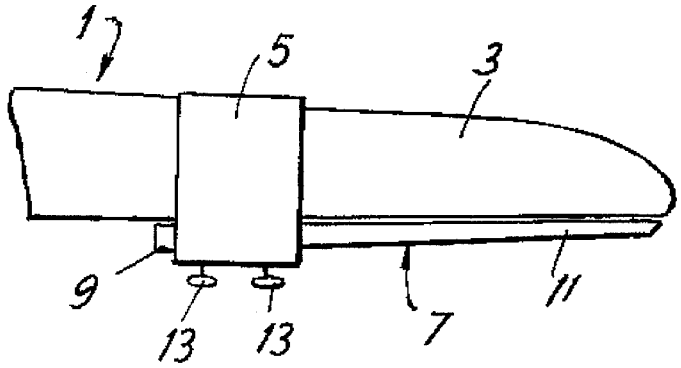
FIG. 1 is a schematic side view of a mouthpiece of a wind instrument.

The schematic side view in FIG. 1 shows a wind instrument 1 in which a sound-producing reed 7 is clamped in the region of a mouthpiece 3 by a reed clamp 5 serving as a clamping device so that the shank 9 of the reed is pressed firmly against the mouthpiece 3 of the wind instrument, while the opposite end, the tip 11 of the reed 7, can vibrate over an opening in the mouthpiece 3 when The wind instrument is played. In the present embodiment example, the reed clamp cooperates, for example, with a ring which is clamped around the mouthpiece 3, two clamping screws 13 being screwed into the underside of the ring via a thread. These clamping screws 13 tighten the ring in such a way that the shank 9 of the reed 7 is pressed against the underside of The mouthpiece 3. Thus, the reed can be held by reducing the circumference of the ring or by the direct action of the screws.

The design of the mouthpiece depends on the type of wind instrument in question and possibly also on its tonal range.

Figure 2:
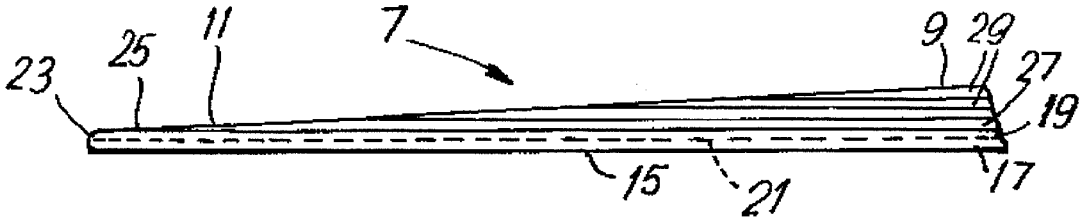
FIG. 2 shows a longitudinal section through the front portion of a reed.

FIG. 2 is a greatly enlarged view of a longitudinal section through a sound-producing reed 7 as shown in FIG. 1. The sectional view clearly shows that in the present embodiment example there are two layers 17 and 19 at the underside 15 of the reed 7 which closes the opening in the mouthpiece 3 shown in FIG. 1. The lower layer is designated as the carrier layer 17 and the layer above that as the supporting layer 19. The dividing plane 21 between the carrier layer and supporting layer is indicated by a dashed line.

In the present embodiment example, the carrier layer 17, together with the supporting layer 19, runs parallel to the underside 15 of the reed 7. Two layers, namely the carrier layer 17 and supporting layer 19, are located in the foremost region of the tip 11 of the reed in the region of the edge 23. The dividing plane 21 between these layers is arranged in such a way that it lies halfway between the underside 15 and upper side 25 of the tip of the reed.

One carrier layer 17 and one supporting layer 19 are provided in the embodiment example shown in FIG. 2. However, the number of layers can be adapted to the size of the reed and can also be decided based on the desired tonal qualities.

A plurality of damping layers 27 and 29 arranged one above the other, whose quantity and thickness can be selected depending on the type of sound-producing reed and the desired tonal qualities, are clearly shown above the carrier layer and supporting layer, in particular in the region of the reed 7 on the right-hand side, i.e., in the region of the shank 9.

Figure 3:
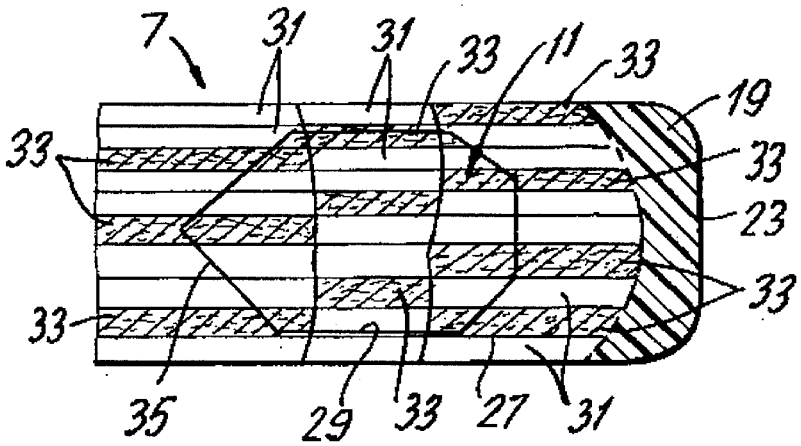
FIG. 3 shows a top view of the front region of a reed.

The top view shown in FIG. 3 of the front end of the reed 7 shows that the damping layers 29 and 27 end at a distance from the edge 23 of the reed tip 11 and that the supporting layer 19 of the reed 7 is visible in the region at the very front of the reed 7.

Although schematic, the view of the reed 7 in FIG. 3 shows that the damping layers have unidirectional fiber strands extending approximately in the longitudinal direction of the reed 7. The hatching indicates that some of the fiber strands of the damping layers 29 and 27 are made of a different material. Hollow fiber strands 33 inside the individual damping layers are indicated in FIG. 3. Fiber strands made from glass fibers or aramid fibers or microtubes made of flexible ceramics or glass hollow fibers having appropriate damping characteristics can also be used in place of strands formed from hollow fibers.

Since the thickness of the reed 7 decreases more or less continuously from the shank 9 toward the front edge 23 of the tongue 11 (see FIG. 2), the individual layers 27 and 29 end at an increasing distance from the edge 23 of the reed tip 11, the upper layers being arranged at a greater distance from the edge 23 than the bottom layer 27. Consequently, the unidirectional fiber strands of the damping layer 27 which is supported directly on the supporting layer 19 reach almost to the front edge 23 of the reed tip 11.

The selected steepness of the thickness slope shown in FIG. 2 can vary depending on the overall thickness of the reed and on the desired sound or tonal qualities so that the individual damping layers end correspondingly at a smaller or greater distance from the front edge 23 of the reed 7.

The top view in FIG. 3 shows that a damping layer or damping ply 35 is arranged on the upper side of the reed in the region adjoining the tip of the reed in this embodiment example. In the present case, the width of the damping ply 35 is selected in such a way that its longitudinal sides do not reach all the way to the lateral longitudinal edge of the reed, its rear transverse side has a roughly triangular shape and its from transverse side facing the reed tip has a roughly trapezoidal shape. The shape and dimensioning of the damping ply 35 are varied depending on the magnitude of the reed and on the desired sound qualities. It is also possible to insert the damping ply between two layers, in which case the from end of the damping ply 35 facing in the direction of the edge 23 of the tongue 11 can be made level with the adjoining layers so that the damping ply ends with the dividing layer lying between the two adjacent layers.

However, in the view shown in FIG. 3, it is assumed that the damping ply is arranged on the upper side of the reed, preferably by gluing, and is constructed as a sheet or foil, particularly as a self-adhesive foil.

The individual damping layers 27 and 29 which can be made from carbon-fiber woven fabrics, can have stabilizing strands (not shown in FIGS. 2 and 3) running transversely to their fiber strands 31 and 33. These stabilizing strands can comprise hollow fibers, aramid fibers, kevlar fibers, carbon fibers and/or glass fibers. The strands add to the stability of the individual layers and sound-producing reed 7. These transversely extending fibers are softer than the longitudinally oriented fibers of the carbon-fiber woven fabric so that the reed is stiffer in the longitudinal direction than in the transverse direction and consequently possesses the characteristics typical of a cane reed. The transverse fibers reduce the risk of initial or edge tearing of the reed and their thickness and quantity are a determining factor in the damping characteristics of the reed.

Figure 4:
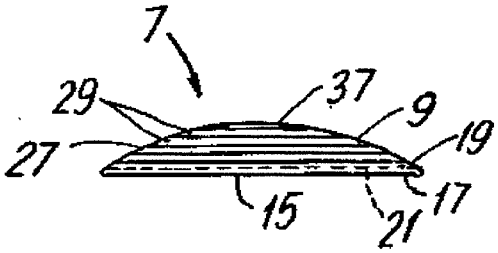
FIG. 4 shows a cross section through the rear region of a reed.

Finally, FIG. 4 shows a highly schematic view of a cross section through the region of the shank 9 of a reed 7. It can be seen that the underside 15 of the reed 7 is flat and that the two bottom layers, the carrier layer 17 and supporting layer 19, and their dividing plane 21 extend parallel to the underside 15 of tile reed 7. The damping layers 27 and 29 which were already mentioned above are located above the carrier and supporting layers. In addition, a cover layer 37 may also be provided in the region of the shank 9.

The sectional view shows that the upper side of the reed 7 is curved in the region of the shank 9. The upper side of the cover layer 37 can follow the curvature of the rest of the reed or can be flat. A flat construction of the upper side of the cover layer 37 results in a particularly good contact surface for the clamping screws 13 of the reed clamp 5 (see FIG. 1). A reed 7 constructed in this way can therefore be fastened to the mouthpiece of a wind instrument in a particularly reliable manner. The reed can also be attached to the mouthpiece of an instrument in another manner, e.g., by means of a strip of fabric. The design of the shank 9 can be adapted to the particular fastening means. Further, it is possible to insert a resilient clamping or tensioning body between the reed and the reed clamp so as to particularly benefit the free vibration of the reed.

The sound-producing reed 7 described with reference to FIGS. 1 to 4 is made from plastic. A plurality of fiber layers are integrated in a plastics compound or plastics matrix which is made, e.g., from epoxy resin or phenolic resin.

The base of the reed 7 forms a carrier layer 17 having fiber strands which extend at 90-degree angles relative to one another. These fiber strands can simply be laid one on top of the other or can be interwoven. The selected angle between the fiber strands also need not be 90 degrees. Depending on the dimensions of the reed and its sound qualities, a plurality of carrier layers can also be used. The fiber bundles of the carrier layer are preferably formed by carbon fibers. Every layer in the present example has a thickness of 12/100 mm, for example. The width of a fiber bundle may be roughly 1 mm.

A supporting layer 19 is arranged above the carder layer 17 and can be constructed in a manner identical to the latter in principle. However, the orientation of the fiber bundles of the supporting layer is different from that of the fiber bundles of the carrier layer. For example, the fiber bundles of the supposing layer 19 may enclose an angle of 90° relative to one another and an angle of 45° relative to the fiber bundles of the carrier layer. The fiber bundles of the supporting layer can also have an angle other than 90° relative to one another. As a result, layers lying one upon the other have fiber strands disposed at various angles relative to one another within one layer and from one layer to the next. The thickness of the supporting layer, like the thickness of the carrier layer, can vary depending on the overall thickness of the reed and on its sound qualities. The width of the fiber bundles, roughly 1 mm in the present example, can also vary.

The thickness of the sound-producing reed 7 is approximately 1/10 mm in the region of the edge 23 of the reed tip 11. The carrier layer and supporting layer are arranged in such a way that there is at least one carrier layer and at least one supporting layer, their dividing plane 21 being arranged approximately in the center of the edge of the reed as shown in FIG. 2.

Located above the carrier and supporting layers is a plurality of layers of fiber strands, preferably constructed as carbon-fiber woven fabric, extending in one direction and aligned in the longitudinal direction of the reed. Individual fiber strands of the woven fabric are replaced by hollow fibers, e.g., osmotic fiber strands. Fibers used for dialysis can also be employed. When appropriate, different types of hollow fibers can be combined. It is essential that the fiber strands inserted in the woven fabric have damping characteristics which can be used to influence the sound of the reed.

Depending on the thickness and characteristics of the individual fibers, every hollow fiber strand can have, e.g., 30 or approximately 120 hollow fibers. The number and width of hollow fiber strands, however, is variable, as is the number of individual fibers provided within these strands. In the present embodiment example, the width of the hollow fiber strands is the same as that of the fiber strands of the carbon-fiber woven fabric.

In a preferred embodiment example with optimum tonal characteristics, the inner diameter of the hollow fibers is 20 μm and the outer diameter is 40 μm. These dimensions can be adapted to the desired sound properties and damping characteristics.

The damping of the movement of the sound-producing reed and accordingly its sound can be influenced by the quantity of hollow fiber strands. The ratio of carbon fiber strands is preferably 1:1. The carbon fiber,hollow fiber woven fabric can be stabilized by means of very fine, widely spaced 22-tex glass fibers.

The sound-producing reed is manufactured by embedding the individual carrier layers, supporting layers and damping layers one upon the other in the plastics matrix. The basic body can be heated to harden the plastics compound. The hardening can also be effected under pressure. The production of fiber composites and accordingly the production of the blank and basic body of the sound-producing reed are known.

After the blank of the sound-producing reed is made, all layers extend more or less parallel to one another. In addition, the cover layer 37 mentioned with reference to FIG. 4 can also be arranged as a top layer. This cover layer 37 can be a carbon-fiber woven fabric whose fiber bundles extend at an angle of 90° relative to one another. However, the angle of these fiber strands can also be varied. It is also possible to provide a plurality of cover layers one on top of the other. The cover layer 37 preferably has the same number of layers as the carrier and supporting layers. It serves exclusively to produce symmetry so that the blank does not warp after the matrix has hardened.

After producing the blank, the reed tip is fashioned by a process of material removal, e.g., by grinding, by removing the material of the blank in the region of the cut-out, as it is called [Translator's Note: The German word "Ausstich" is translated literally as 'cut-out'; however, in German technical jargon it may have a different meaning not found in standard reference works], so that the thickness of the reed 7 decreases more or less continuously proceeding from the shank 9 until the front edge 23 of the reed tip 11. The thickness gradient, which is shown by way of example in the longitudinal section in FIG. 2, can be selected as in conventional sound-producing reeds and adapted to the desired sound characteristics.

In addition, the surface curvature can be fashioned on the upper side 25 in the region of the shank 9. However, the underside 15 must first be surfaced by grinding so as to provide the blank of the reed 7 with an optimal support surface for further processing. This is essential especially for fashioning the very sensitive reed tip 11, since the latter might otherwise slip during the subsequent grinding process and could thus obtain an indefinite thickness. The tip of the reed might also break free during grinding. Grinding the reed prevents individual droplets from forming on the reed when played, which droplets interfere with use and tone. Instead, a moisture film is produced on the underside of the reed.

After grinding the upper surface of the reed 7 and fashioning the reed tip, a damping ply 35 can be arranged in the region of the upper side of the reed tip. The material for this ply can be selected optionally depending on the desired tonal qualities. For example, a self-adhesive plastics foil can be applied. The shape of the damping ply 35 can be selected depending on the dimensions and sound qualities of the sound-producing reed. By varying the dimensions and arrangement of the damping ply, characteristic sound qualities can be given to the sound-producing reed in accordance with the wishes of the individual player.

Non-hollow aramid fibers can also be used in the damping layers in place of the hollow fibers—which may also be made of aramid. However, this results in a somewhat coarser surface of the reed. This difference compared with sound-producing reeds having hollow fibers in the damping layers can be compensated for in part by means of a larger damping ply. Further, in the present embodiment form, as also in the other embodiment forms, the upper side or upper surface of the reed can be provided with a lacquer coat so as to achieve a smooth outer surface of the reed. Shellac has proven particularly advantageous in this respect.

Of course, it is also possible to replace the carbon fibers of the carbon-fiber woven fabric of the damping layers with hollow fibers and aramid fibers, i.e., to introduce a combination of hollow fibers and aramid fibers in the damping layer. The hollow fibers and non-hollow aramid fibers serve to damp the vibrations of the sound-producing reed, while the carbon fibers provide the reed with the requisite stiffness.

In a preferred embodiment form of a sound-producing reed for an alto saxophone, an advantageous construction has approximately 7 to 10 damping layers, a supporting layer and a carrier layer. The thickness of this reed in the region of the shank 9 is approximately 1.7 mm.

The number of layers must be increased in sound-producing reeds for tenor, baritone and bass saxophones, since the reed in this case must be thicker. In soprano and sopranino saxophones, the thickness of the reed must be decreased in a corresponding manner.

In every case, the underside 15 of the reed 7 is surface-ground, the carrier layer 17 being partially removed. In the finished reed 7, the upper side of the supporting layer 19 in the region of the edge 23 is also removed by the material removing or grinding process so that the dividing plane 21 between the career layer and supporting layer is situated roughly in the middle between the upper side 25 and underside 15 of the reed tip 11.

The two layers with fiber fabric extending at an offset relative to one another provides the edge 23 of the reed tip 11 with particular stability so that tearing is very reliably prevented.

So-called microballoons can be introduced in one or more layers in the resin of the plastics matrix in order to influence the damping characteristics, and accordingly the sound characteristics, of the reed. In so doing, it is also possible to provide such microballoons in only some regions of the layers. The materials for the microballoons, e.g., inorganic silicates, glass, cork, fiber materials or the like, are selected depending on the desired properties of the reed. A cork size of 0.01 to 0.018 mm has proven particularly advantageous. Other resin fillers such as talc, wood flour, glass fiber shavings, cotton flock, aluminum powder and the like can be selected to adjust the desired damping characteristics.

The sound characteristics and damping characteristics of a reed can also be influenced by providing the resin of the plastics matrix with a plasticizer. The plasticizer can also be introduced into one or more layers or can be applied in one or more layers in only some regions.

Further, as was already mentioned above, the properties of the reed can be influenced by applying resins, lacquers and/or adhesives subsequently to the top and/or bottom of the surface of the reed. Depending on the desired tonal characteristics, a continuous layer may be applied or only some regions of the upper side and underside of the reed can be wetted.

Methylmethacrylate-containing resin solutions, e.g., containing dibenzoyl peroxide as hardener and N,N-diethanol p-toluidine as activator, have proven particularly advantageous for producing the plastics matrix. Moreover, it is also possible to add pigments to the various resins and/or to add fillers, e.g., microballoons of inorganic silicates, fiber materials or powder materials, in order to reduce density.

Generally, the bottom layers of the reed, the supporting layer and carrier layer, are constructed without damping However, in order to influence the sound properties and damping characteristics, plasticizers can also be introduced into these layers and/or other additives, microballoons or fibrous fillers can be included. This may vary from layer to layer and may also be effected in only some regions, as the case may be. If the damping layers have a sufficient inherent stability, the carrier layer and/or supporting layer can also be omitted.

It was already noted that the dividing plane between the supporting layer and carrier layer should be arranged as close as possible to the center of the outermost edge of the reed 7. But it is also possible to use a nonwoven carbon fiber web with no defined fiber orientation instead of the layers described above. In this case, the grinding process can be carried out in the region of the tip without taking into account any dividing planes so as to simplify production of the reed. The higher fiber content in the nonwoven web also provides the reed with increased stability and resistance to initial tearing.

In order to adjust damping the plastics matrix of the nonwoven carbon fiber web, like the other regions of the reed, can be provided with a resin characterized by increased damping properties.

It should also be noted that the lower layers of the reed—but also other layers if need be—can be constructed as hybrid woven fabrics characterized by the use of carbon fibers in one fiber direction and aramid and/or glass fibers in another fiber direction at an optional angle relative to the first direction. The use of carbon fibers for the longitudinal fibers of the reed has resulted in particularly advantageous sound characteristics. Further, the use of resin-impregnated carbon fibers which are pressed into the form of a blank or a reed under pressure—also accompanied by the application of heat when appropriate—has proven advantageous. In the latter case, grinding work can be dispensed with or at least sharply reduced. The material of the reed is characterized by a fiber content of 40% to 60%, preferably 50%. The use of hollow fibers with porous walls and moisture-absorbent material has proven particularly advantageous.

In view of the preceding remarks, it will be understood generally that carbon fibers, aramid fibers and/or glass fibers can be used in all layers of the reed.

The sound-producing reed described herein is also characterized by its very long useful life. Due to the particularly flat underside which cannot swell up during playing, very uniform sound qualities can be achieved ever with prolonged use of the reed. Moreover, it is not necessary to break in the reed before using. In the case of wooden reeds, a certain swelling process of the wood fibers was necessary before the reed could achieve the desired sound characteristics. This is not possible and is also unnecessary in the sound-producing reed described herein. The desired sound characteristics are already achieved immediately upon first playing the reed.

We claim:

1. A sound-producing reed for wind instruments, comprising:

a first layer made of a plastic material; and at least one damping layer having a plurality of unidirectional fiber strands extending approximately in a longitudinal direction of the reed and formed of different materials having different damping characteristics.

2. A reed according to claim 1, wherein the fiber strands includes strands comprising hollow fibers.

3. A reed according to claim 1, wherein the fiber strands includes strands formed of at least one of glass fiber, aramid fiber and microtubes of flexible ceramic.

4. A reed according to claim 1, wherein at least one of width and thickness of the fiber strands is selected in accordance with desired damping characteristics.

5. A reed according to claim 1, wherein the fiber strands includes strands comprising carbon fibers.

6. A reed according to claim 1, wherein the damping layer comprises a carbon fiber woven fabric.

7. A reed according to claim 1, wherein the damping layer includes stabilizing strands extending transverse to the longitudinal direction of the reed.

8. A reed according to claim 7, wherein the stabilizing strands comprise at least one of carbon fibers, aramid fibers, glass fibers and fibers of flexible ceramic.

9. A reed according to claim 1, wherein the first layer is formed as a carrier layer having fibers extending substantially at right angles relative to each other.

10. A reed according to claim 1, further comprising a supporting layer having fibers extending substantially at right angles relative to each other, with the fibers of the supporting layer being offset relative to the fibers of the first, carrier layer.

11. A reed according to claim 10, wherein at least one of the carrier and supporting layers comprises at least one of carbon fibers, hollow fibers, aramid fibers and glass fibers.

12. A reed according to claim 10, wherein the carrier and supporting layers are arranged at an underside of the reed, and wherein the damping layer lies above the carrier and supporting layers.

13. A reed according to claim 1, wherein the reed comprises a shank having a tap and a front edge, and wherein a thickness of the reed decreases from the tap to the front edge.

14. A reed according to claim 1, wherein the reed has longitudinal edges, and wherein a thickness of the reed decreases from an imaginary center line of the reed to the longitudinal edges.

15. A reed according to claim 1, wherein the first layer is a carrier layer, and wherein the reed comprises a supporting layer and seven damping layers lying one on top of another and above the carrier and supporting layers.

16. A reed according to claim 1, wherein the reed has an underside and a tap, and wherein at least one of the underside and at least a region of the tab has a ground area.

17. A reed according to claim 1, wherein the reed has a tip having an upper side, an underside, and an edge, wherein at least two layers are provided in a region of the tip edge, and wherein a dividing plane between the two layers is arranged approximately in middle between the upper side and the underside.

18. A reed according to claim 1, wherein the reed has a substantially flat underside, and wherein the first layer defines a carrier layer extending along the entire underside.

19. A reed according to claim 1, wherein the reed has an upper side and a tip, and wherein a damping ply is arranged on the upper side in a region of the tip.

20. A reed according to claim 19, wherein dimensions and shape of the damping ply is selected in accordance with desired sound characteristics of the reed.

21. A reed according to claim 19, wherein the damping ply is formed as an adhesive foil.

22. A reed according to claim 1, comprising a lacquer coating.

23. A reed according to claim 22, wherein the lacquer coating comprises a shellac layer.

* * * * *